US005969692A

United States Patent [19]

Ishizuka

[11] Patent Number: 5,969,692

[45] Date of Patent: Oct. 19, 1999

[54] ANTENNA SUPPORT FABRIC

[75] Inventor: Hironobu Ishizuka, Tokyo, Japan

[73] Assignee: NEC Corporation, Tokyo, Japan

[21] Appl. No.: 08/861,220

[22] Filed: May 21, 1997

[30] Foreign Application Priority Data

Jun. 4, 1996 [JP] Japan ..... 8-141774

[51] Int. Cl.[6] ..... H01Q 19/12

[52] U.S. Cl. ..... 343/840; 343/765; 343/878; 343/882

[58] Field of Search ..... 343/840, 878, 343/880, 882, 757, 763, 765

[56] References Cited

U.S. PATENT DOCUMENTS

| | | | |
|---|---|---|---|
| 3,162,858 | 12/1964 | Cutler | 343/840 |
| 4,656,484 | 4/1987 | Brown et al. | 343/761 |
| 4,804,971 | 2/1989 | Bruns et al. | 343/840 |
| 4,998,114 | 3/1991 | Eto et al. | 343/840 |
| 5,061,945 | 10/1991 | Hull et al. | 343/840 |
| 5,212,493 | 5/1993 | Cluniat et al. | 343/765 |

FOREIGN PATENT DOCUMENTS

| | | |
|---|---|---|
| 58-95405 | 6/1983 | Japan . |
| 59-187209 | 12/1984 | Japan . |
| 60-127005 | 8/1985 | Japan . |
| 62-44509 | 3/1987 | Japan . |
| 63-30008 | 2/1988 | Japan . |
| 63-302606 | 9/1988 | Japan . |
| 3-270502 | 12/1991 | Japan . |
| 4-133501 | 5/1992 | Japan . |
| 4-126407 | 11/1992 | Japan . |
| 800306 | 8/1958 | United Kingdom . |
| 2292481 | 2/1996 | United Kingdom . |

*Primary Examiner*—Don Wong
*Assistant Examiner*—Tho Phan
*Attorney, Agent, or Firm*—Foley & Lardner

[57] ABSTRACT

An antenna support fabric including an arm (10), a support table (20), a fixing plate (60) which is rotatably secured to the support table (20), a reflection mirror (50) which is detachably fixed to one surface of the fixing plate (60), a primary radiator (40) which is detachably fixed to one surface of the fixing plate (60) through a through hole (51) provided to the reflection mirror (50), and a transceiver (30) which is detachably fixed to the other surface of the fixing plate (60), and engaged with and connected to a projecting portion (41) of the primary radiator (40) through a through hole (62) of the fixing plate (60).

14 Claims, 11 Drawing Sheets

ANTENNA SUPPORT FABRIC

BACKGROUND OF THE INVENTION

1. Field of the Invention

The present invention relates to an antenna support fabric for an antenna which is used as a ground station for microwave communication and adapted to support a reflection mirror, a transceiver, a primary radiator, etc. so that these units are freely detachably joined to one another and are adjustable, and more particularly to an antenna fabric in which each of a reflection mirror, a primary radiator and a transceiver of an antenna can be independently and freely detachably fixed to and supported by a fixing member.

2. Description of Related Art

There has been hitherto known an antenna support fabric for freely detachably coupling a reflection mirror, a primary radiator, a transceiver, etc. to one another, and supporting and fixing these units so that adjustments in direction, etc. of each of these units can be performed.

FIGS. 1 and 2 are perspective views showing a conventional and general antenna support fabric.

In the antenna support fabric shown in FIG. 1, a transceiver 120 to which a primary radiator 110 is connected is detachably fixed to a bent arm 140 which is fixed to a rear surface of a reflection mirror 130, which is mounted on a universal head (not shown) so that the reflection mirror 130 and the arm 140 are detachably fixed to a folding tripod 150 via the universal head.

Further, in the antenna support fabric shown in FIG. 2, a transceiver 220 is directly fixed to the back surface of a reflection mirror 210 by a screw or the like, and the transceiver 220 is mounted on a universal head 240 which is freely rotatably fixed to an antenna mount place such as a pole 230 or the like, thereby fixing and supporting the transceiver 220.

According to the antenna support fabric as described above, each of the reflection mirror, the primary radiator, the transceiver, etc. is freely detachable. Therefore, the antenna support fabric can be easily transported by decomposing it into respective constituent parts. In addition, for maintenance or check of the constituent parts such as the transceiver, etc., each desired part can be easily detached from the antenna support fabric to facilitate the maintenance and the check of the parts.

As such a conventional antenna support structure are known a portable tripod type antenna frame disclosed in Japanese Laid-open Utility Model Application No. Sho-60-127005, a portable antenna apparatus disclosed in Japanese Laid-open Patent Application No. Sho-63-302606 or the like.

However, in the conventional antenna support fabrics as described above, particularly in the case of the fabric shown in FIG. 1, when the transceiver 120 is detached from the universal head for maintenance, check or the like, the primary radiator 110 is unintentionally detached together with the transceiver 120, and the positional relationship between the primary radiator 110 and the reflection mirror 130 is varied. Therefore, after the transceiver 120 is fixed to the universal head again, the direction of the antenna must be adjusted again.

Further, in the case of the fabric shown in FIG. 2, the reflection mirror 210 of the antenna is directly fixed to the transceiver 220 by a screw or the like, and the transceiver 220 is interposed between the reflection mirror 210 and the universal head 240. Therefore, when the transceiver 220 is detached for the check or the like, the overall antenna is detached from the universal head 240, and thus the direction of the antenna must be adjusted again.

Still further, in these conventional antenna support fabrics, a connection means such as a cable, a waveguide or the like is required to prevent leakage of radio wave which is transmitted between the transceiver and the primary radiator.

In addition, in order to directly join the transceiver and the primary radiator, a joint force must be applied to the joint portion to prevent leakage of radio wave. Therefore, the transceiver and the primary radiator must be firmly joined to each other by a screw or the like.

SUMMARY OF THE INVENTION

An object of the present invention is to provide an antenna support fabric in which a reflection mirror, a transceiver, a primary radiator, etc. can be independently and freely detachably fixed and supported.

In order to attain the above object, an antenna support fabric according to the present invention is characterized by including a fixing plate, a reflection mirror which is detachably fixed to one surface of the fixing plate, a primary radiator which is detachably fixed to one surface of the fixing plate, and a transceiver which is detachably fixed to the other surface of the fixing plate and is connected to the primary radiator.

Further, the antenna fabric according to the present invention may be designed so that the reflection mirror has a through hole at the center thereof, and the fixing plate has a through hole at the position corresponding to the through hole of the reflection mirror, one end of the primary radiator being connected to the transceiver through the through hole of the reflection mirror and the through hole of the fixing plate.

Still further, the antenna support fabric according to the present invention may be designed so that a projecting portion is formed at one end of the primary radiator and the transceiver is provided with a recess portion with which the projecting portion of the primary radiator is engaged.

According to the antenna support fabric of the present invention thus constructed, each of the primary radiator, the reflection mirror and the transceiver is independently fixed to the fixing plate. Therefore, even when the transceiver is detached from the fixing plate for maintenance, check or the like of the transceiver, the primary radiator and the reflection mirror are kept to be fixed to the fixing plate, so that it is unnecessary to re-adjust the antenna every time check or the like.

In addition, the primary radiator and the transceiver are directly connected to each other, and thus any connection means such as a cable, a waveguide or the like is never required. Further, both the primary radiator and the transceiver are connected to each other in a joint structure, so that no joint member such as a screw or the like is necessary to prevent leakage of radio wave.

DETAILED DESCRIPTION OF THE PREFERRED EMBODIMENTS

An antenna support fabric according to the present invention will be described hereunder with reference to the accompanying drawings.

Figure 1:
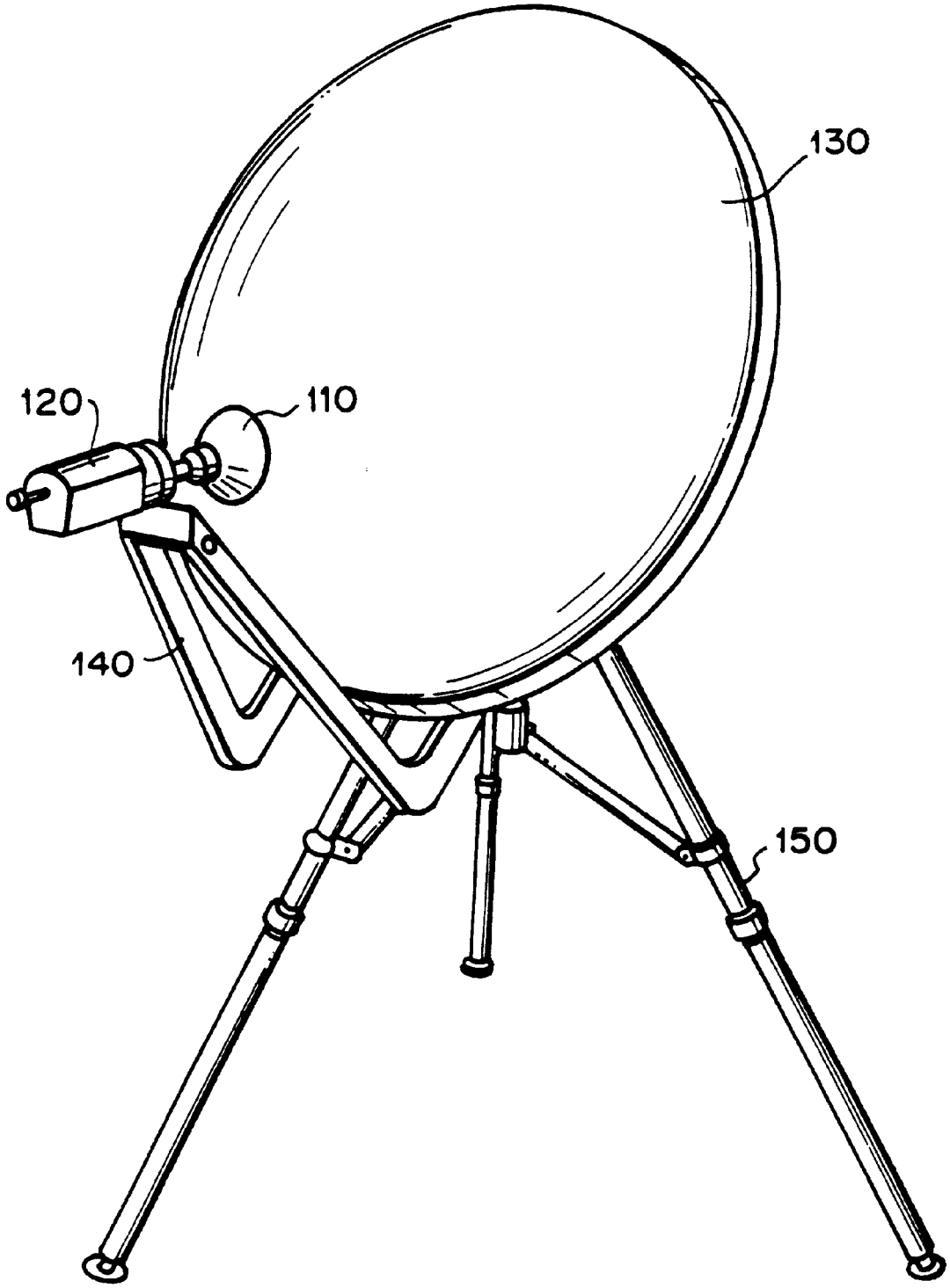
FIG.1 PRIOR ART
FIG. 1 is a perspective view showing the overall structure of a conventional antenna support fabric.
Figure 2:
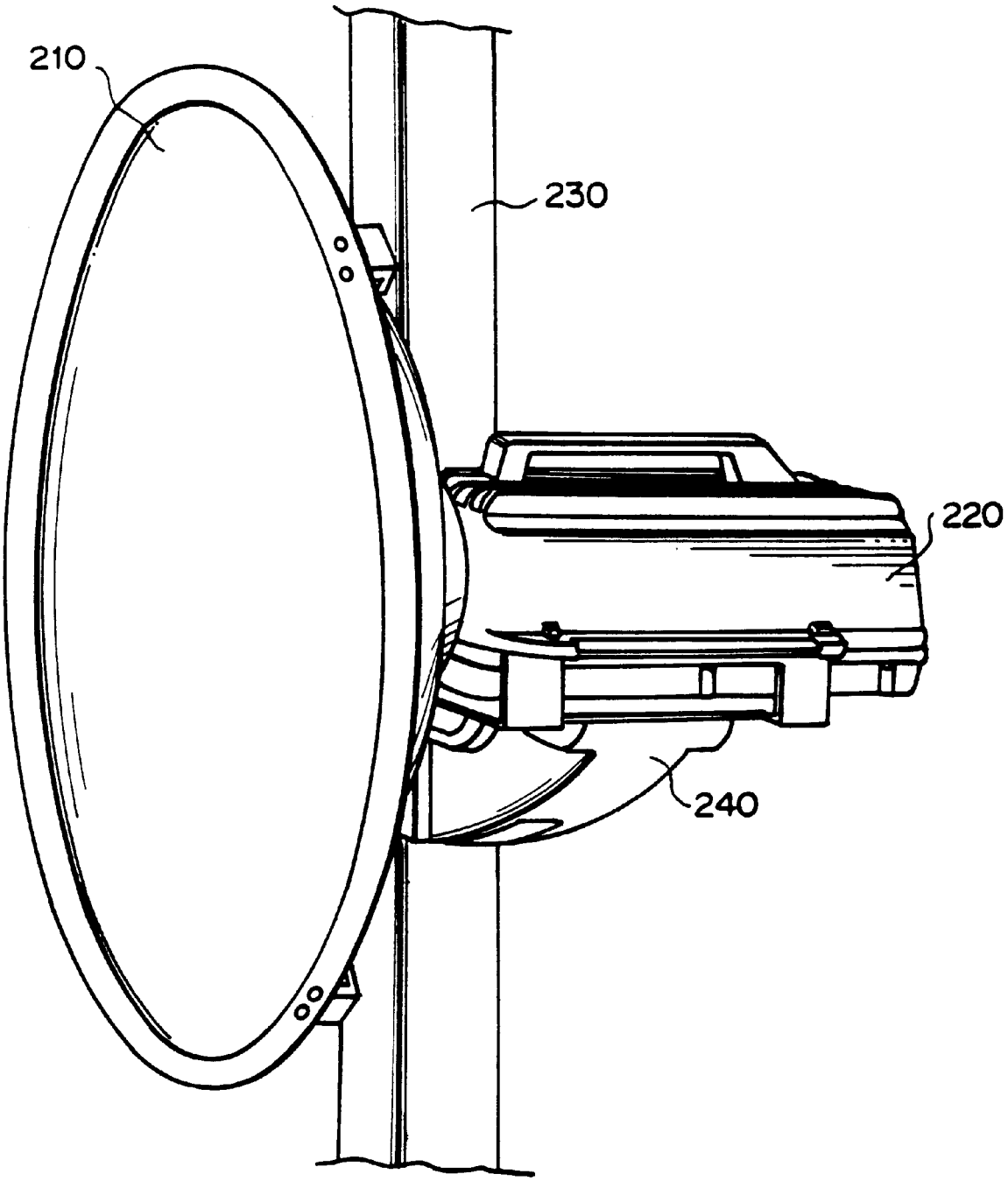
FIG. 2 PRIOR ART
FIG. 2 is a perspective view showing the overall construction of a conventional antenna support fabric.
Figure 3:
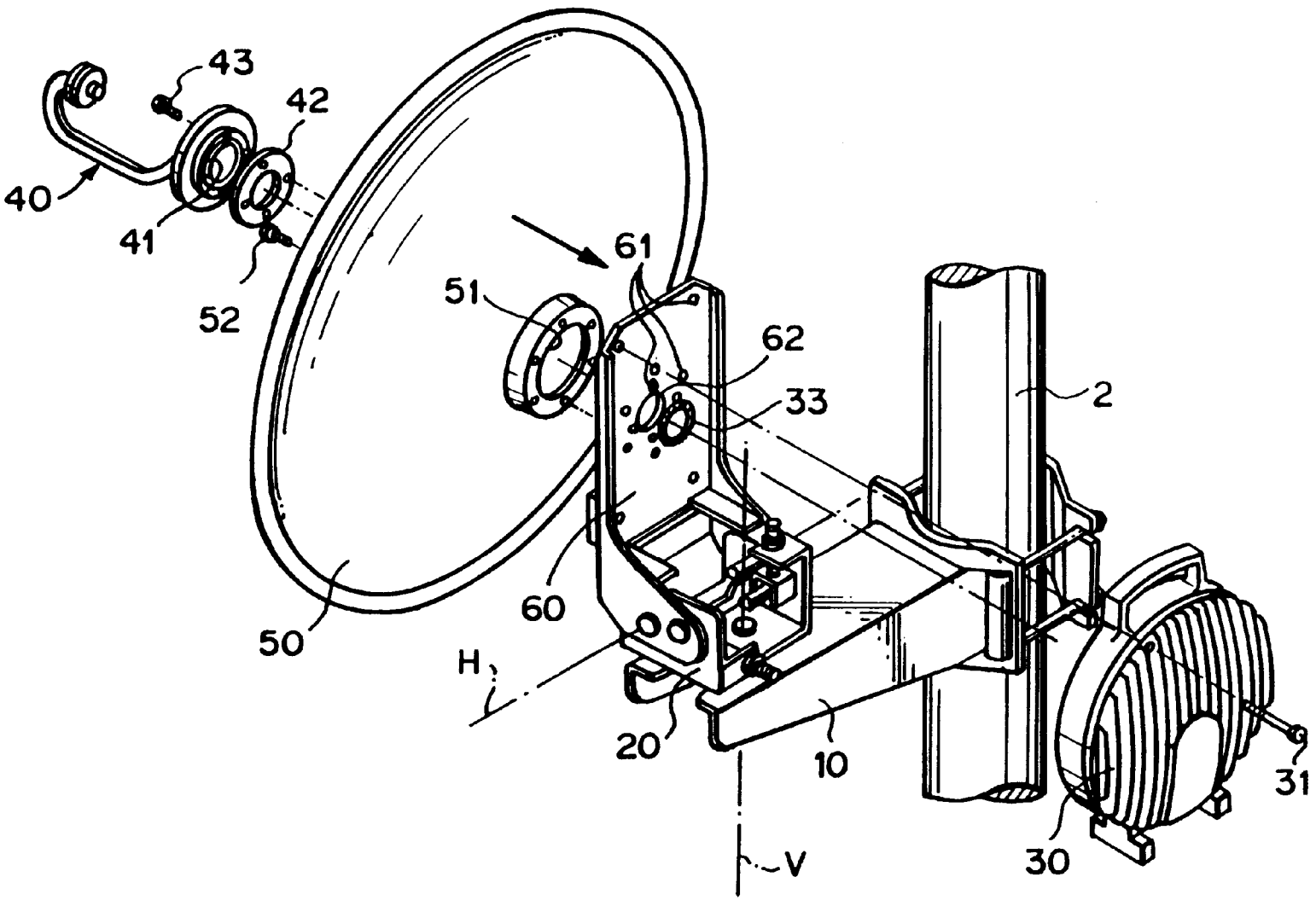
FIG. 3 is an exploded perspective view showing an embodiment of an antenna support fabric according to the present invention.
Figure 4:
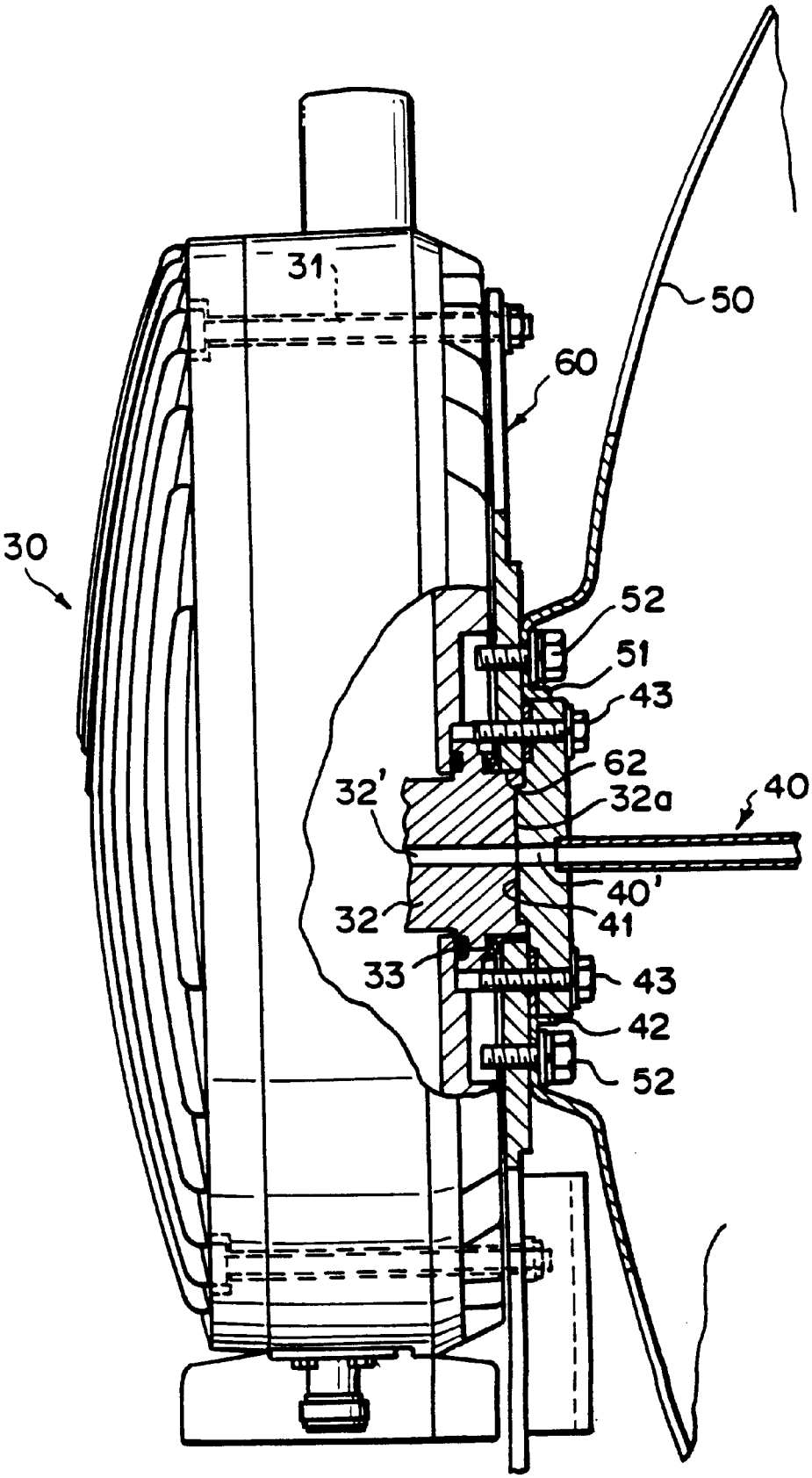
FIG. 4 is a partially cross-sectional view showing a fixing portion according to the embodiment of the antenna support fabric of the present invention.
Figure 5:
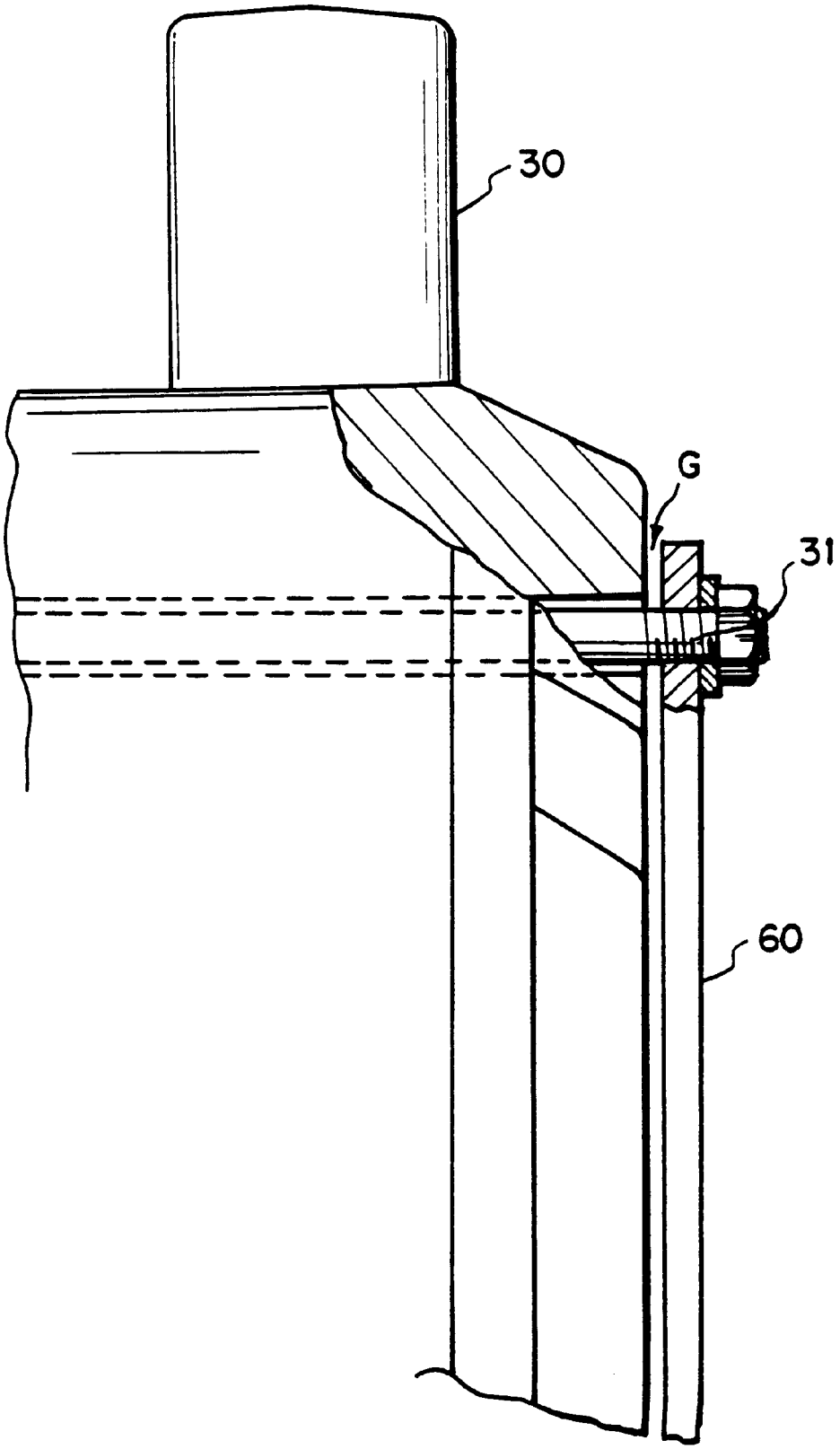
FIG. 5 is an enlarged cross-sectional view showing a fixing portion of the antenna support fabric shown in FIG. 4.
Figure 6:
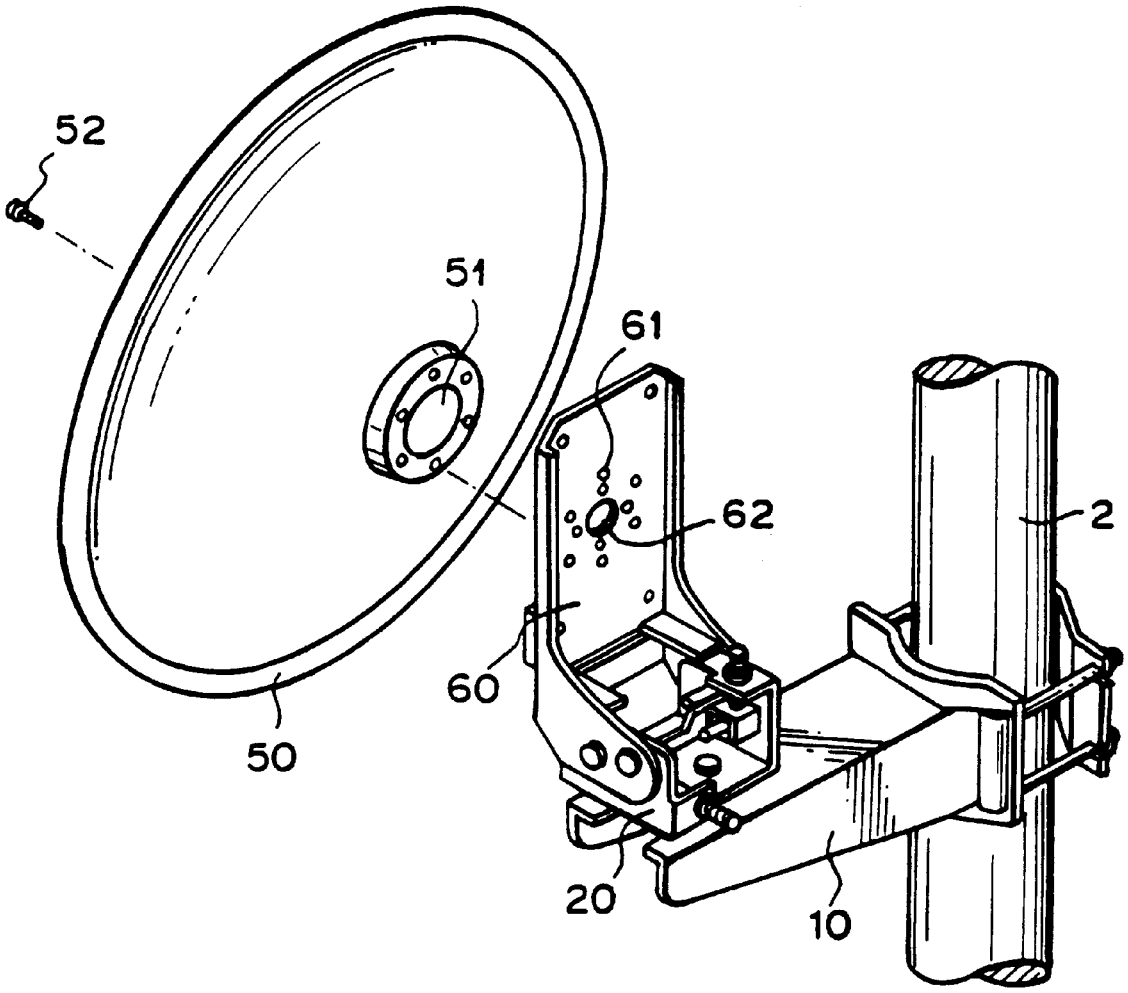
FIG. 6 is a perspective view showing a mount and securing procedure of the embodiment of the antenna support fabric according to the present invention.

FIG. 3 is an exploded perspective view showing an antenna support fabric according to an embodiment of the present invention, FIG. 4 is a partially cross-sectional side view showing the antenna support fabric according to the embodiment, and FIG. 5 is an enlarged cross-sectional view showing a main part of the antenna support fabric shown in FIG. 4.

In these figures, reference numeral 10 represents an arm, and the arm 10 is fixedly secured to an antenna mount place such as a steel tower, a pole 2 on the roof or the like. Reference numeral 20 represents a support table. The support table 20 is mounted on the arm 10, and a transceiver 30, a primary radiator 40 and a reflection mirror 50 which constitute an antenna are detachably fixed to the support table 20 through a fixing plate 60.

As shown in FIG. 3, the fixing plate 60 is fixed to the support table 20 at the lower end side thereof so as to be rotable around the rotational center axis H in the horizontal direction relatively to the support table 20. Further, the support table 20 is fixed to the arm 10 so as to be rotatably around the rotational center axis V in the vertical direction relatively to the arm 10. This structure provides the function of a universal head which can freely adjust the direction and angle of the antenna.

Further, as shown in FIG. 3, the fixing plate 60 is provided with plural screw holes 61 through which each of the transceiver 30, the primary radiator 40 and the reflection mirror 50 is independently fixed to the fixing plate 60, and a through hole 62 which is used to directly join the primary radiator 40 and the transceiver 30 to each other.

As shown in FIG. 4, the reflection mirror 50 is detachably fixed to the fixing plate 60 from one surface side of the fixing plate 60 by a screw 52.

A through hole 51 which has a larger diameter than the through hole 62 of the fixing plate 60 is formed at the center of the reflection mirror 50 so as to confront the through hole 62 so that one end of the primary radiator 40 penetrates through the through holes 51 and 62 as described later.

As in the case of the reflection mirror 50, the transceiver 30 is fixed to the fixing plate 60 from the other surface side of the fixing plate 60 by a screw 31. As shown in FIG. 4, the transceiver 30 is provided with an adaptor 32 having a recess portion 32*a* which is used for positioning when the primary radiator 40 is joined to the transceiver 30. Further, as shown in FIG. 4, the recess portion 32*a* of the adaptor 32 is disposed substantially at the center of both the through hole 62 of the fixing plate 60 and the through hole 51 of the reflection mirror 50, and the transceiver 30 and the primary radiator 40 are joined to each other through these through holes 62 and 51. In FIG. 4, reference numeral 33 represents an O-ring for waterproof.

The primary radiator 40 is disposed at the front surface side of the reflection mirror 50. One end of the primary radiator 40 penetrates through the through hole 51 of the reflection mirror 50, and is detachably fixed to the peripheral portion of the through hole 62 of the fixing plate 60 by screws 43.

As shown in the figures, when viewing the antenna support fabric with the through holes 51 and 62 at the center, the screws 43 for fixing the primary radiator 40 to the fixing plate 60 are disposed at a more inward position in the radial direction than the screws 52 for fixing the reflection mirror 50 to the fixing plate 60. Further, the screw 31 for fixing the transceiver 30 is disposed at a more outward position in the radial direction than the screws 43 and 52.

The one end of the primary radiator 40 is provided with a projecting portion 41 which is engaged with the recess portion 32*a* of the adaptor 32 of the transceiver 30 (see FIGS. 3 and 4), and the projecting portion 41 penetrates through the through hole 62 of the fixing plate 60 to be engaged with the recess portion 32*a* of the adaptor 32. With this structure, the primary radiator 40 is directly joined to the transceiver 30 through the through holes 62 and 51. In FIGS. 3 and 4, reference numeral 42 represents a seal member for waterproof.

As shown in FIG. 4, the outer periphery of the adapter 32 at the fixing plate side is projected, and the O-ring 33 is interposed between the adaptor 32 and the peripheral edge of the through hole 62 of the fixing plate 60 to form a gap G between the transceiver 30 and the fixing plate 60 as shown in FIG. 5. Accordingly, by screwing down the screw 31 for fixing the transceiver 30 to the fixing plate 60, the fixing plate 60 is bent to the transceiver side to produce stress, and the joint portion of the transceiver 30 and the primary radiator 40 is urged by the stress. Therefore, the transceiver 30 and the primary radiator 40 can be firmly joined to each other without using any means of directly screwing the transceiver 30 and the primary radiator 40 or the like. By joining the transceiver 30 and the primary radiator 40 to each other, a waveguide 32' of the adaptor 32 and a waveguide 40' of the primary radiator 40 are allowed to intercommunicate with each other.

Next, a method of mounting and fixing the antenna support fabric of this embodiment as described above will be described with reference to FIGS. 6 to 9.

First, the arm 10 is fixed to an antenna mount place such as a pole 2 of a steel tower or the like, and the support table 20 and the fixing plate 60 are fixed to the arm 10. Thereafter, the reflection mirror 50 is disposed at the front surface side of the fixing plate 60, the through holes 62 and 51 are positioned, and then the reflection mirror 50 is fixed to each other by a screw (the state shown in FIG. 6).

Figure 7:
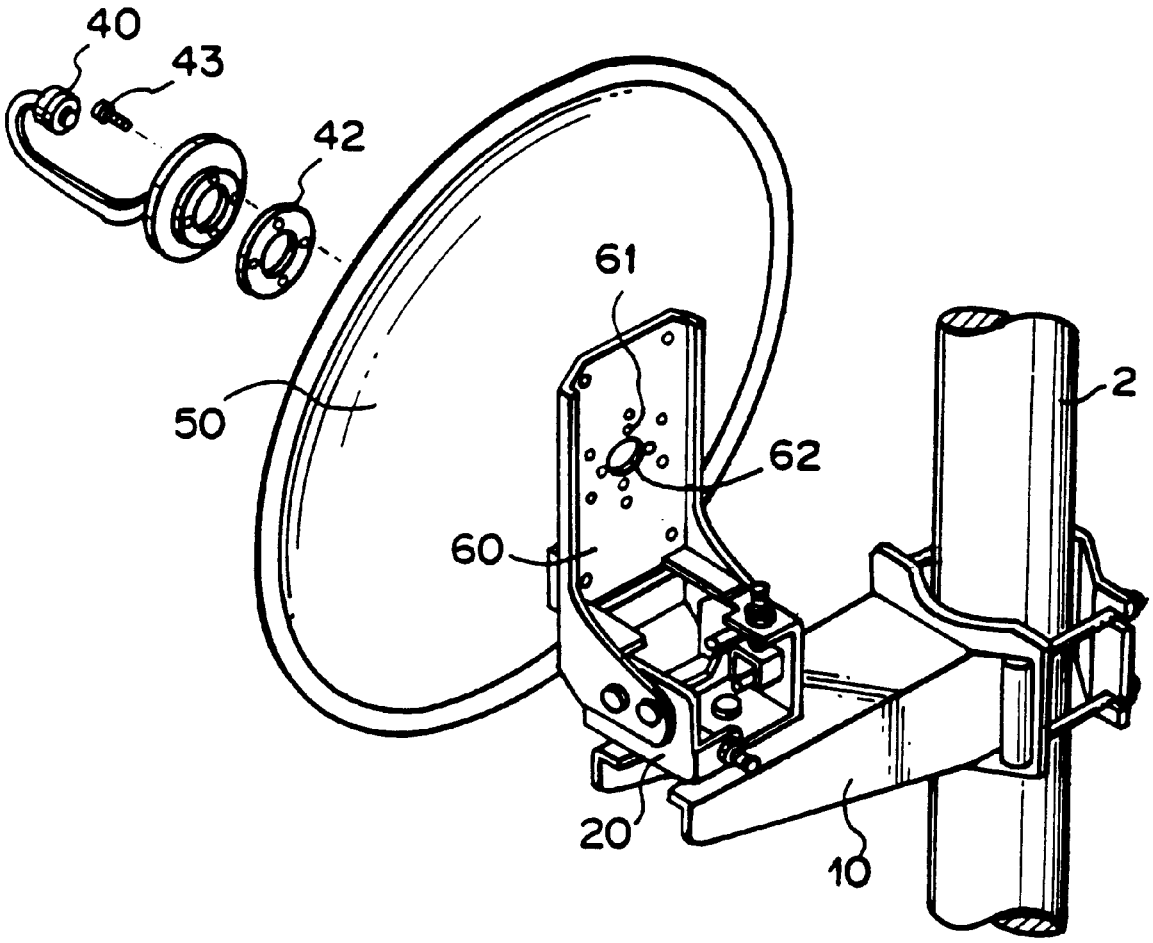
FIG. 7 is a perspective view showing a mount and fixing procedure of the embodiment of the antenna support fabric according to the present invention.

Subsequently, the primary radiator 40 is inserted through the through hole 51 from the front surface side of the reflection mirror 50, and fixed to the fixing plate 60 through the seal member 42 (the state shown in FIG. 7).

Figure 8:
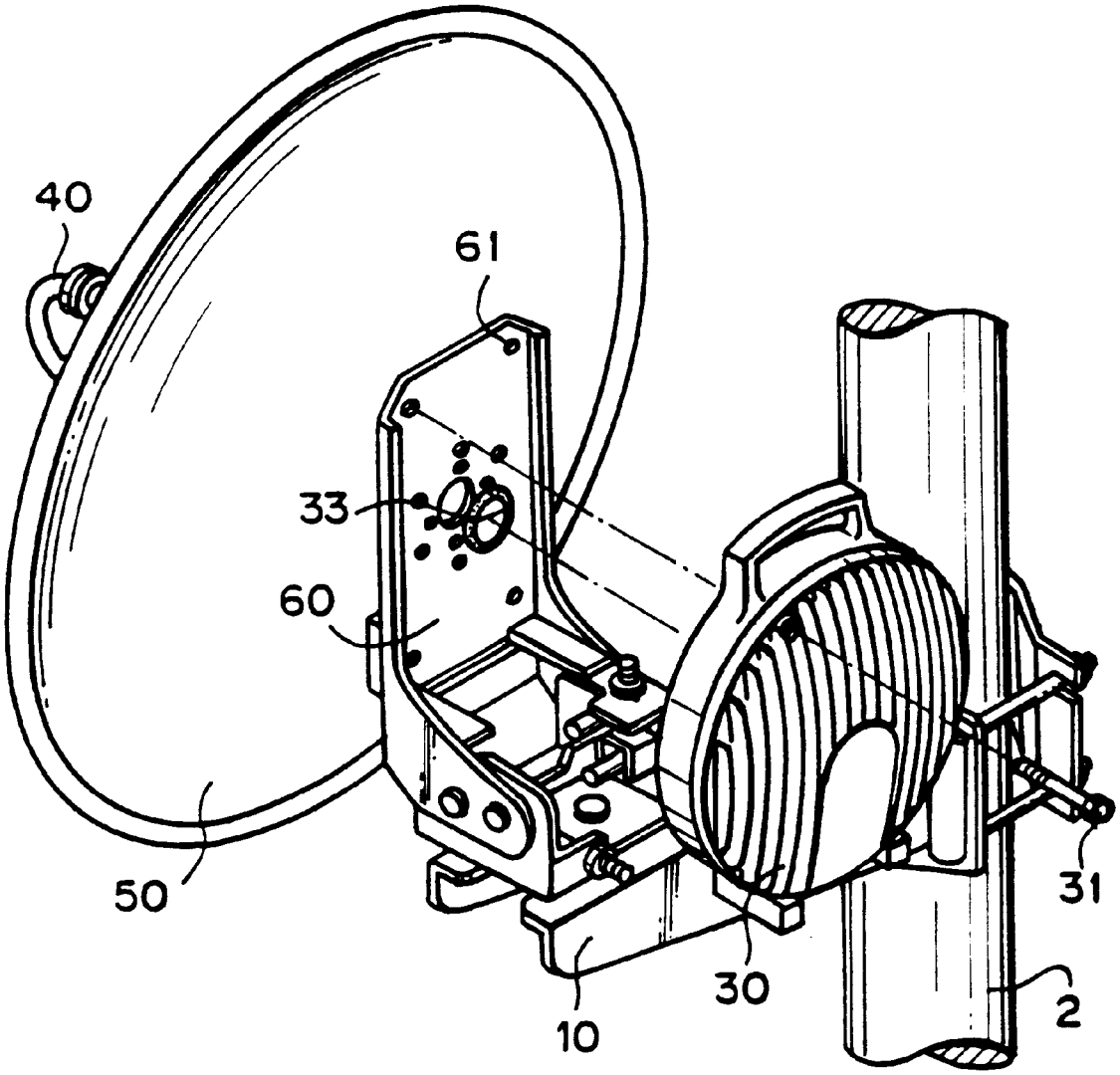
FIG. 8 is a perspective view showing a mount and fixing procedure of the embodiment of the antenna support fabric according to the present invention.
Figure 9:
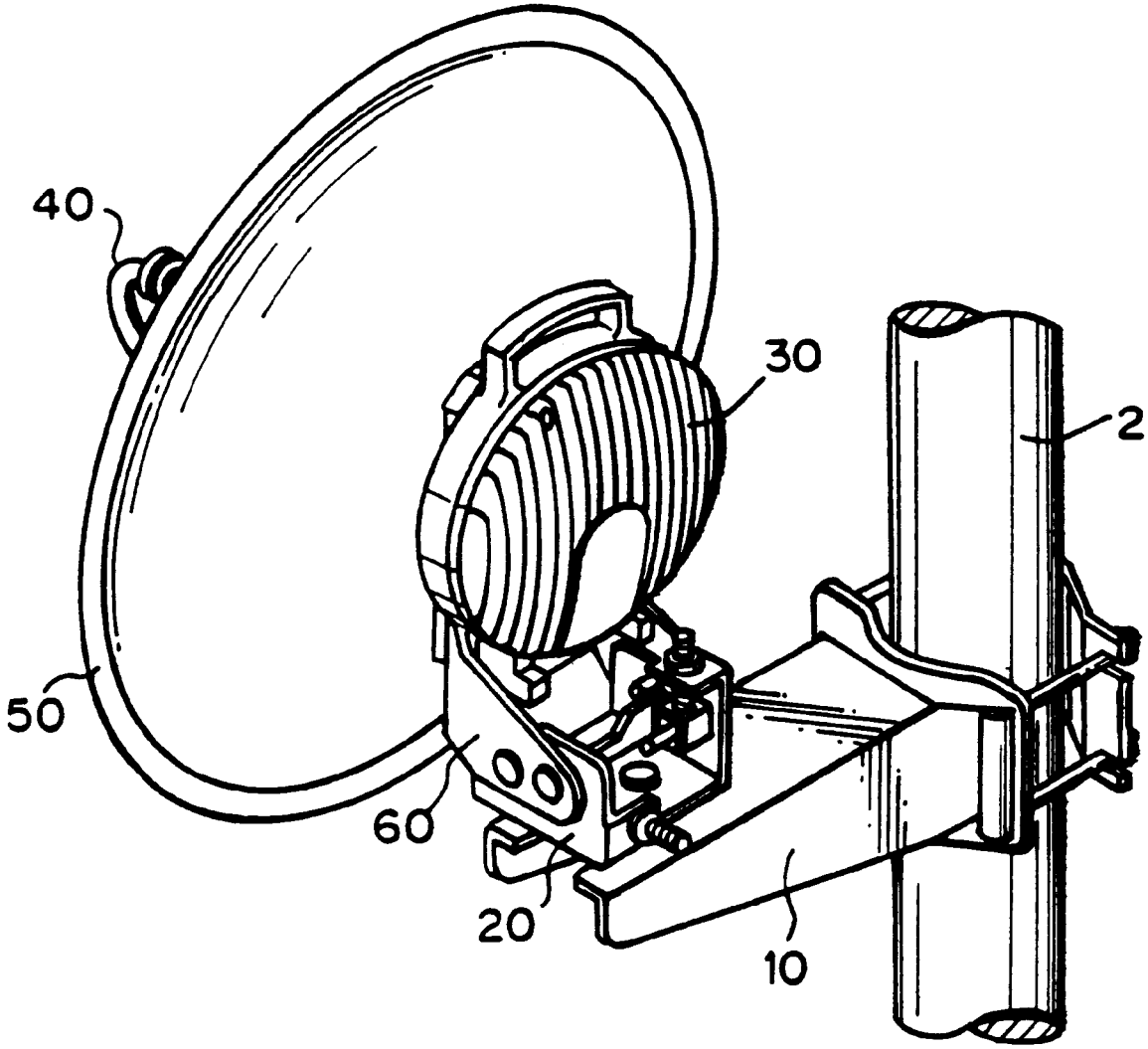
FIG. 9 is a perspective view showing a mount and fixing procedure of the embodiment according to the present invention.

Thereafter, as shown in FIG. 8, the transceiver 30 is disposed from the back surface side of the fixing plate 60, the adaptor 32 is positioned to the through hole 62 of the fixing plate 60 and fixed to the fixing plate 60 by the screw 31, and the recess portion 32*a* of the transceiver 30 is engaged with the projecting portion 41 of the primary radiator 40. At this time, the waterproof O-ring 33 is disposed between the transceiver 30 and the fixing plate 60. With this arrangement, the mount of the antenna is completed (the state shown in FIG. 9).

As described above, each of the transceiver 30, the primary radiator 40 and the reflection mirror 50 is independently fixed to the fixing plate 60, and the transceiver 30 and the primary radiator 40 are directly joined to each other by securing these parts to the fixing plate 60. Accordingly, the primary radiator 40 and the transceiver 30 are not directly joined to each other by a screw or the like, and thus even when the transceiver 30 is detached from the fixing plate 60 for maintenance or check, the primary radiator 40 and the reflection mirror 50 are left on the fixing plate 60 and the support table 20, so that the positional relationship between the primary radiator 40 and the reflection mirror 50 is unvaried at all times and thus the direction of the antenna is not deviated (i.e., fixed) at all times.

Figure 10:
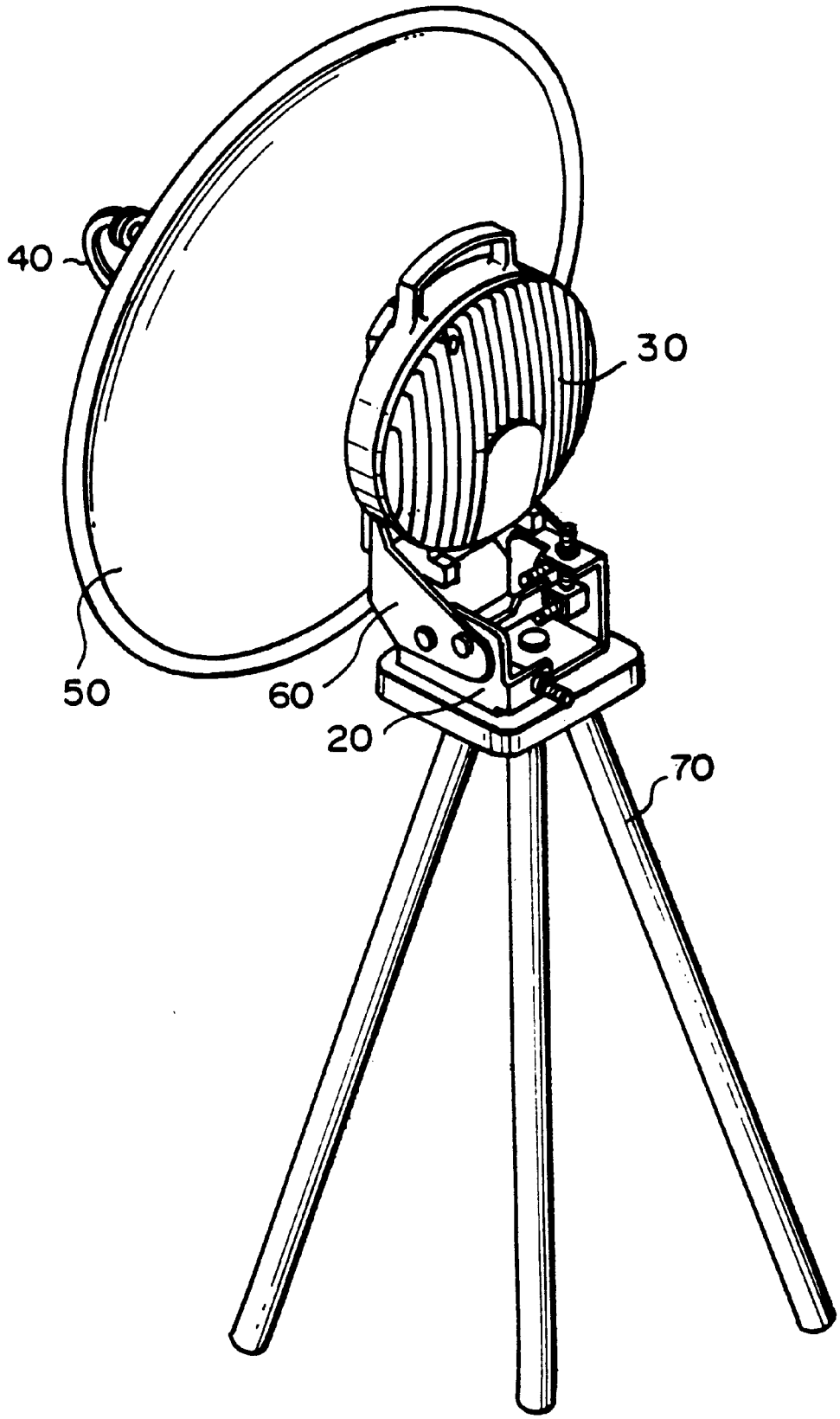
FIG. 10 is a perspective view showing another embodiment of the antenna support fabric according to the present invention.
Figure 11:
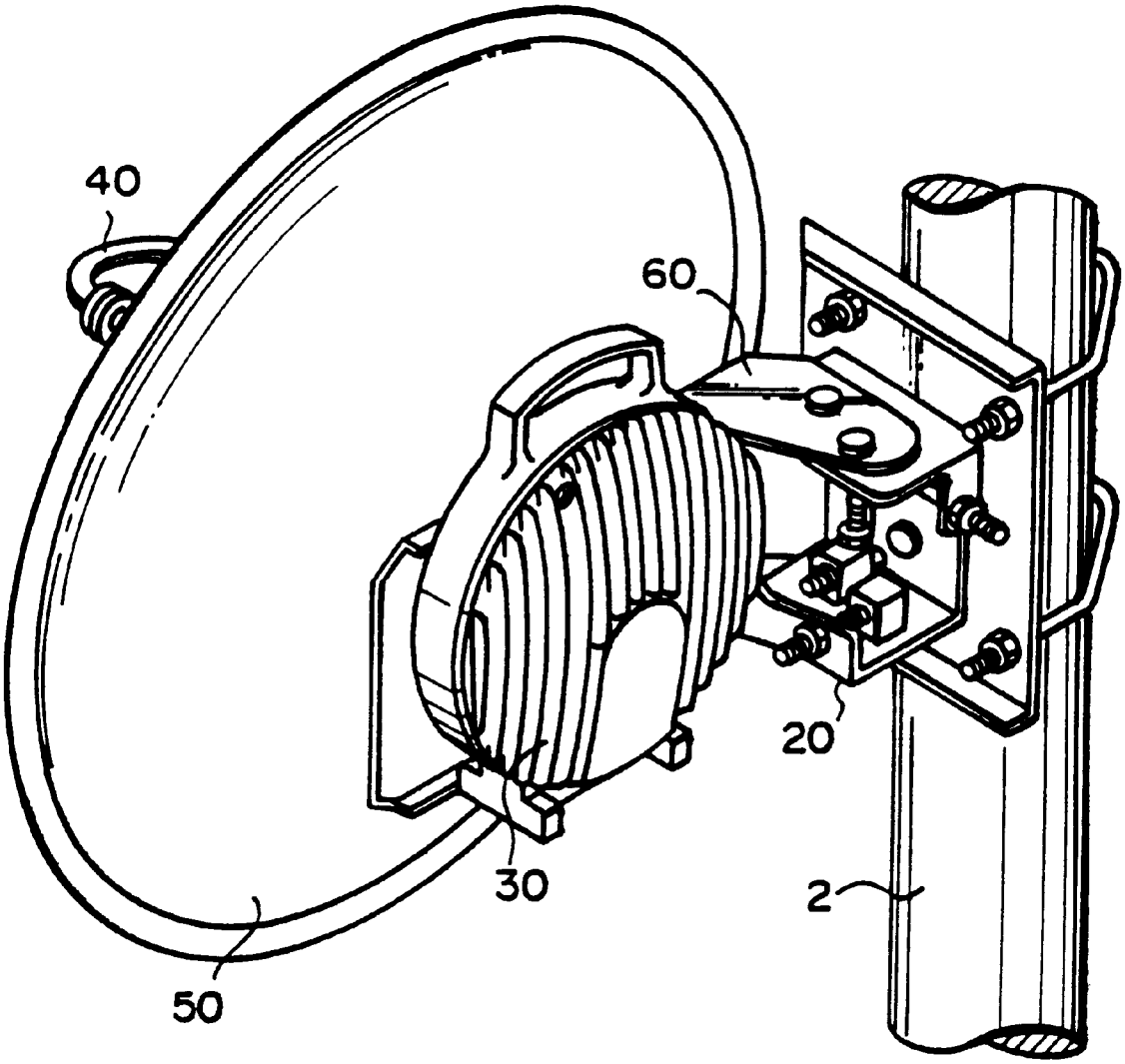
FIG. 11 is a perspective view showing another embodiment of the antenna fabric structure according to the present invention.

The antenna support fabric of the present invention is not limited to the above-described embodiment, and various modifications may be made. For example, in place of the arm 10 mounted on the steel tower, a tripod 70 may be used as shown in FIG. 10, or the arm 10 may omitted and the support table 20 may be directly fixed to a mount place such as a steel pole 2 or the like as shown in FIG. 11.

As described above, according to the antenna support fabric of this embodiment, each of the transceiver 30, the primary radiator 40 and the reflection mirror 50 can be independently fixed to the support table 20, and the primary radiator 40 and the reflection mirror 50 remain fixed to the fixing plate 60 and the support table 20 even when the transceiver 30 is detached for the maintenance/check of the transceiver 30, so that it is not required to re-adjust the antenna every check.

Further, since the primary radiator 40 and the transceiver 30 are directly connected to each other by fixing these on the fixing plate 60, any additional connection means such as a cable, a waveguide or the like is not required. In addition, the primary radiator 40 and the transceiver 30 are connected to each other in the engagement structure, so that a joint work using a screw or the like to prevent the leakage of radio wave is not required.

Still further, according to the antenna support fabric of this embodiment, the detachment of the transceiver 30 is performed from the back surface side of the antenna, that is, the back surface side of the reflection mirror 40, and thus the maintenance/check work even at a high place can be readily and safely performed.

As described above, according to the present invention, in the antenna support fabric for freely detachably joining the reflection mirror, the transceiver, the primary radiator, etc. of the antenna to one another and adjustably supporting these parts, each of the reflection mirror, the primary radiator and the transceiver can be independently and detachably fixed and supported.

What is claimed is:

1. An antenna support fabric comprising:

a reflection mirror which is detachably fixed to one surface of a fixing plate by first fixing means;

a primary radiator which is detachably fixed to the one surface of said fixing plate by second fixing means; and a transceiver which is detachably fixed to the other surface of said fixing plate by third fixing means, said transceiver and said primary radiator being connected to each other by the fixation of said primary radiator to the one surface of said fixing plate by said second fixing means and the fixation of said transceiver to the other surface of said fixing plate by said third fixing means.

2. The antenna support fabric as claimed in claim 1, wherein a first through hole is provided at the center of said reflection mirror and a second through hole is provided to said fixing plate so as to confront said first through hole of said reflection mirror, said transceiver and said primary radiator being connected to each other through said first through hole of said reflection mirror and said second through hole of said fixing plate.

3. The antenna support fabric as claimed in claim 2, wherein the fixing position of said primary radiator to said fixing plate by said second fixing means is at the inside of the fixing position of said reflection mirror to said fixing plate by said first fixing means.

4. The antenna support fabric as claimed in claim 1, wherein the fixing position of said transceiver to said fixing plate by said third fixing means is at the outside of the fixing position of said primary radiator to said fixing plate by said second fixing means.

5. The antenna support fabric as claimed in claim 1, wherein said transceiver is pushed against said primary radiator by the fixation of said transceiver to said fixing plate by said third fixing means.

6. The antenna support fabric as claimed in claim 1, wherein said primary radiator is provided with a projecting portion at one end of said primary radiator, and said transceiver is provided with a recess portion which is engaged with said projecting portion of said primary radiator.

7. The antenna support fabric as claimed in claim 1, wherein a first waveguide of said transceiver and a second waveguide of said primary radiator intercommunicate with each other by the fixation of said primary radiator to said fixing plate by said second fixing means and the fixation of said transceiver to said fixing plate by said third fixing means.

8. The antenna support fabric as claimed in claim 1, wherein said fixing plate is rotatably secured to a support table.

9. An antenna support fabric comprising:

an arm configured to be detachably fixed to an antenna mount;

a support table configured to be detachably fixed to said arm;

a fixing plate configured to be rotatably attached to said support table, said fixing plate being positioned such that said fixing plate is in a substantially perpendicular direction with respect to said arm;

a reflection mirror which is configured to be detachably fixed to a first surface of said fixing plate;

a primary radiator which is configured to be detachably fixed to said first surface of said fixing plate; and a transceiver configured to be detachably fixed to a second surface of said fixing plate opposite said first surface, wherein a first waveguide of said transceiver and a second waveguide of said primary radiator intercommunicate with each other when said transceiver and said primary radiator are detachably fixed to said fixing plate.

10. The antenna support fabric as claimed in claim 9, wherein said reflection mirror, said primary radiator and said transceiver are detachably fixed to said fixing plate by way of screws.

11. The antenna support fabric as claimed in claim 10, wherein said primary radiator is detachably fixed to said fixing plate by way of a first plurality of said screws attached to a first plurality of holes in said fixing plate that correspond to a first concentric circle, and wherein said reflection mirror is detachably fixed to said fixing plate by way of a second plurality of said screws attached to a second plurality of holes in said fixing plate that correspond to a second concentric circle that is larger in size than said first concentric circle.

12. The antenna support fabric as claimed in claim 11, wherein said transceiver is detachably fixed to said fixing plate by way of a third plurality of said screws attached to a third plurality of holes in said fixing plate, said third plurality of holes being positioned closer to edges of said fixing plate than said first and second plurality of holes.

13. The antenna support fabric as claimed in claim 9, wherein said fixing plate and said reflection mirror have opposing through holes.

14. The antenna support fabric as claimed in claim 9, wherein said primary radiator is provided with a projecting portion at one end of said primary radiator, and wherein said transceiver is provided with a recess portion which is configured to be engaged with said projecting portion of said primary radiator when said primary radiator and said transceiver are detachably fixed to said fixing plate.

* * * * *